US005444456A

United States Patent [19]

Ohta et al.

[11] Patent Number: 5,444,456

[45] Date of Patent: Aug. 22, 1995

[54] LED DISPLAY APPARATUS

[75] Inventors: Masuo Ohta; Yukinobu Sako, both of Katano, Japan

[73] Assignee: Matsushita Electric Industrial Co., Ltd., Kadoma, Japan

[21] Appl. No.: 140,623

[22] Filed: Oct. 21, 1993

Related U.S. Application Data

[63] Continuation of Ser. No. 889,063, May 26, 1992, abandoned.

[30] Foreign Application Priority Data

May 23, 1991 [JP] Japan ..... 3-036707 U
Jun. 13, 1991 [JP] Japan ..... 3-141626
Dec. 17, 1991 [JP] Japan ..... 3-103882 U

[51] Int. Cl.[6] ..... G09G 3/20
[52] U.S. Cl. ..... 345/39; 345/46
[58] Field of Search ..... 345/31, 39, 40

[56] References Cited

U.S. PATENT DOCUMENTS 2,437,018 3/1948 Dodson ..... 340/753
3,644,725 2/1972 Lochridge, Jr. ..... 362/32
3,737,722 6/1973 Scharlack ..... 340/755
3,846,784 11/1974 Sinclair ..... 340/755
3,958,235 5/1976 Duffy ..... 340/755
4,213,125 7/1980 Watanabe ..... 340/753
4,225,862 9/1980 Johnson ..... 340/755
4,311,999 1/1982 Upton et al. ..... 340/755
4,470,044 9/1984 Bell ..... 345/31
5,057,827 10/1991 Nobile ..... 345/31
5,068,652 11/1991 Kobayashi ..... 340/762

FOREIGN PATENT DOCUMENTS 2187588 9/1987 United Kingdom ..... 340/753

*Primary Examiner*—Curtis Kuntz
*Assistant Examiner*—Minsun Oh
*Attorney, Agent, or Firm*—Ratner & Prestia

[57] ABSTRACT

In connection with a display apparatus that is held and swung by an operator to display images of pictures, letters, etc. in space using an afterimage effect, a party situated opposite to the operator is enabled to recognize the images displayed always at the central position of the swing range and with the same dimensions irrespective of the swinging speed and to see the same images displayed even of an asymmetrical pattern irrespective of the directions of the swing of the apparatus. The display apparatus has a transparent protective case covering both side faces, right and left, of an array of LEDs, a measuring unit to measure the cycle time of right and left reciprocating motion, a computing unit to process by computation the measured cycle time, a memory unit to memorize the processed results and a timer circuit unit to control turning the LEDs on and off. This set-up enables a party situated opposite to the operator of the display apparatus to see correct images of letters and pictures displayed always at the center of the swinging width range regardless of the swinging speed.

11 Claims, 6 Drawing Sheets

LED DISPLAY APPARATUS

This application is a continuation of now abandoned application Ser. No. 07/889,063 filed May 26, 1992.

BACKGROUND OF THE INVENTION

1. Field of the Invention

This invention relates to an LED display apparatus that displays images of pictures, letters, etc. in space utilizing a human eye's afterimage effect as the apparatus is held by an operator's hand and moved with a right and left reciprocating lotion.

2. Description of the Prior Art

A conventional LED display apparatus that utilizes an afterimage effect has consisted of, as shown in FIG. 13, batteries 31 as a power source, a power source switch 32, an array of LEDs 33 mounted on the apparatus body base and a series of timer circuits 34 that turn the LEDs 33 on or off in sequence according to a preprogrammed timing.

How the foregoing LED display apparatus operates is explained in the following:

First, the power source switch 32 is turned on and then each LED of the LED array is turned on, as shown in FIG. 14, for a fixed period $T_Y$ per respective timing program by means of the timer circuits 34 and also for a fixed repeating period $T_X$ that corresponds to one cycle of picture or letter signals. While such an operation is taking place, the LED array is moved with a right and left reciprocating motion and then images of pictures, letters, etc. are made visible in space by an afterimage effect from only one direction as shown in FIG. 15.

However, in this conventional set-up the LED array mounted on the apparatus body base is moved in a reciprocating motion on a plane situated in parallel with the plane that is inclusive of the LED array. Since the LED array has only one light emitting plane, images of pictures, letters, etc. are seen regretfully only from one direction of the front side of the apparatus body. Also, since the LEDs are turned on and off at a fixed interval of time $T_X$ irrespective of the speed of the LED array's right and left reciprocating motion, there exists no synchronization between the LED array motion and the LED's light emission resulting in an unstable formation of images with their positions varied over the range of the right and left reciprocating motion.

In addition, since each LED is turned on only for a fixed period of $T_Y$, images of pictures, letters, etc. tend to look larger by moving the LED display apparatus faster and tend to look smaller by moving the LED display apparatus more slowly.

Furthermore, since the turn on and off sequential order of LEDs is fixed to start from one direction only, the displayed images of asymmetrical pictures, letters, etc. are reversed on the return movement of the apparatus, as shown in FIG. 16 (*a*) and (*b*), making it difficult to distinguish the images and consequently imposing a limitation in the image display capability to displaying symmetrical patterns only.

SUMMARY OF THE INVENTION

Objects of the Invention

The first object of this invention is to provide an LED display apparatus with its LEDs emitting light from both sides of the apparatus so as to have images of pictures or letters displayed in space from both sides, front and back, of the apparatus.

The second object of this invention is to provide an LED display apparatus with its LEDs displaying images at the optimal rate of turn on and off time with reference to the central position of the range, and the speed of the right and left reciprocating motion of the LED display apparatus.

The third object of this invention is to provide an LED display apparatus having images of pictures, letters, etc. displayed in accordance with either a right or left direction of reciprocating motion of the apparatus so that the images are not reversed depending on the direction of the reciprocating motion.

Features of this Invention

This invention discloses a set-up, whereby images of pictures, letters, etc. are displayed by a human eye's afterimage effect in space over the extent of a reciprocating motion of an optical display apparatus held by an operator's hand and moved right and left in a reciprocating motion. The optical display apparatus is composed of an apparatus body with an LED array mounted on it, a transparent protecting case covering the LED array and allowing the light from the LED array to emit in at least two directions, in front and back of the apparatus body, a control unit that turns on and off each of the LEDs according to a preprogrammed timing to display pictures, letters, etc. and batteries contained in the grip of the display apparatus.

In an exemplary embodiment, at least two sides of the transparent protective case are furnished with an edge light effect to form bright optically conductive channels.

In a further exemplary embodiment, a protective case is made in a prismatic form to diverge light by a refraction effect.

In a further exemplary embodiment, a protective case has a rib along the peripheral edges except for the both sides of the LED array and forms an integral body with the display apparatus.

A set-up is also disclosed whereby images of pictures, letters, etc. are displayed in space by an afterimage effect over the extent of a reciprocating motion of an optical display apparatus held by an operator's hand and moved right and left in a reciprocating motion. The optical display apparatus is composed of an apparatus body with an LED array mounted on it, a transparent protective case covering the LED array and allowing the light of the LEDs to emit at least in two directions, front and back, of the apparatus body, a sensor unit that measures the cycle of the right and left reciprocating motion, a memory unit that memorizes turn on and off timing for each LED according to the pictures, letters, etc. to be displayed, a computing unit that computes from the data on one cycle of the right and left reciprocating motion a turn on and off timing for each LED for displaying images pictures, letters, etc. at the central position of the range of the right and left reciprocating motion and has the result of computation stored as a memory in the memory unit, a timer circuit unit that activates on-off timers to turn on and off the LEDs according to the turn on and off timing data from memory unit and batteries contained in the grip of the apparatus body case.

In addition, the foregoing computing unit computes from the data on the measured one cycle of the right and left reciprocating motion the optimal switching timing for displaying images of pictures, letters, etc. with the dimensions of the images being kept constant irrespective of the speed of the right and left reciprocating motion and has the results of computation inputted into the memory unit.

From the timing data outputted from the sensor unit the computing unit computes a turn on and off timing for displaying images of pictures, letters, etc. starting from the left side during the left to right travel of the reciprocating motion and starting in reversal from the right side during the right to left travel.

BRIEF DESCRIPTION OF THE DRAWINGS

FIG. 11(*b*) is a cross-sectional view of the sensor switch taken along the line D—D′ of FIG. 11(*a*) to show the structure of the switch.

FIG. 16(*b*) is a perspective illustration to show how images of a letter are displayed by a conventional LED display apparatus when it is moved from right to left.

Figure 1:
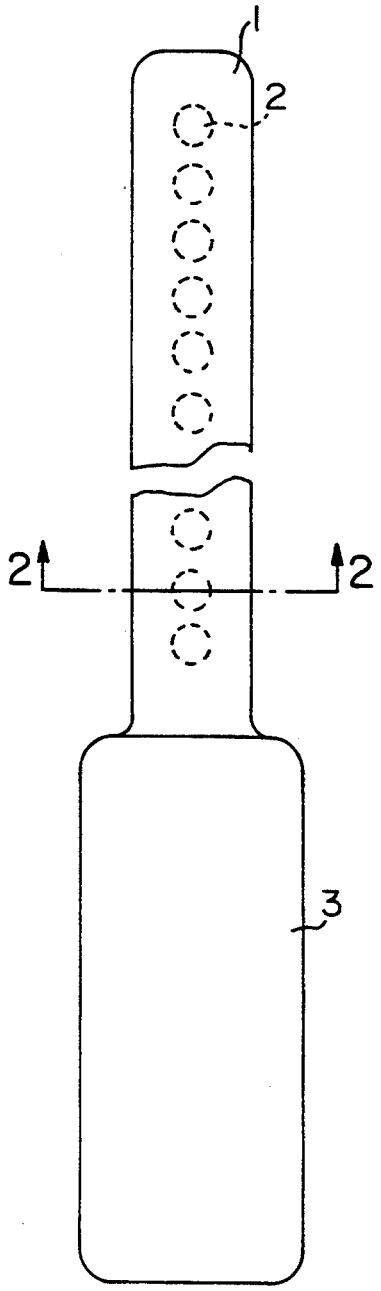
FIG. 1 is a front view of Example 1 of this invention for an LED display apparatus.

Explanation of the symbols used in the figures.

1. Protective case
1*a*. Protective case with open upper side construction
1*b*. Protective case with edge light effect
1*c*. Prism
2. LED array
3. Apparatus body
4 & 14. Apparatus base board
5 & 16. Case
11. Protective case
12. LED array
13. Apparatus body
21. Battery
22. Power source switch
23. LED array
24. Sensor switch
24*a* & *b*. Fixed contact
24*c*. Movable contact
26. Measuring unit
26. Computing unit
27. Memory unit
28. Timer unit
31. Battery
32. Power source switch
33. LED array
34. Timer array

DETAILED DESCRIPTION OF THE INVENTION

Example 1 and Example 2

Examples of exemplary embodiments of this invention for an LED display apparatus are explained in the following with the help of drawings:

FIG. 1 shows an LED display apparatus of Example 1 of this invention. As shown in the drawing, a protective case 1 made from a transparent molded body and an LED array 2 are integrated with the apparatus body 3, which contains batteries and switches, etc.

Figure 2:
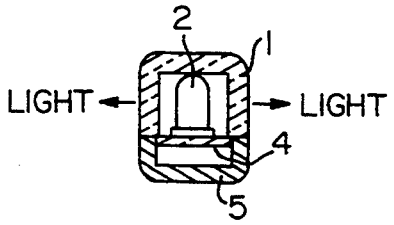
FIG. 2 is a cross-sectional view taken along the line 2—2 of FIG. 1.

FIG. 2 shows a cross-sectional view taken along the line 2—2 of FIG. 1. As shown in this figure, the protective case 1 contains a base board 4 which forms an integral part of the apparatus body 3. An array of LEDs 2 is mounted on the base board 4. The base board 4 and the protective case 1 are put together with a case 5.

Figure 3:
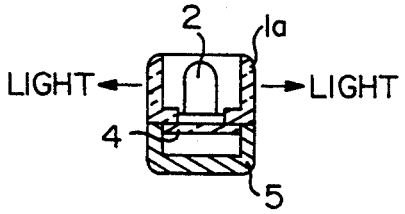
FIG. 3, FIG. 4 and FIG. 5 are cross-sectional views of LED display apparatuses of this invention with protective cases that are different from the one shown in FIG. 1. The respective views are taken along the line corresponding to the line 2—2 of FIG. 1.

FIG. 3 shows a set-up that uses a protective case different from the one of FIG. 1 and the cross-sectional view is taken along the line corresponding to the line 2—2 of FIG. 1. A protective case 1*a* is of a configuration having two sides, one at right and the other at left, and an open upper side.

Figure 4:
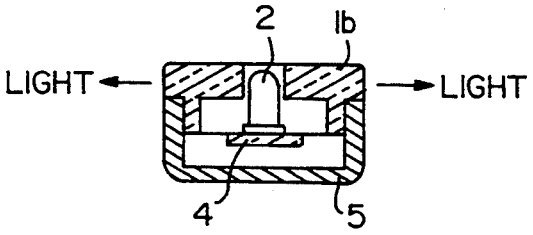

FIG. 4 shows another set-up that uses a further different protective case 1*b* of a covered and oblong configuration with its outer two edges kept sharp to provide an edge light effect (i.e. lighting effect near the edges).

Figure 5:
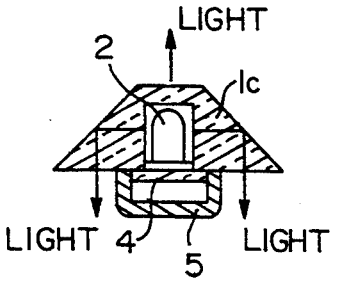

FIG. 5 shows further another set-up that uses a prism-like protective case 1c emitting a brilliant light by a prism effect.

Figure 6:
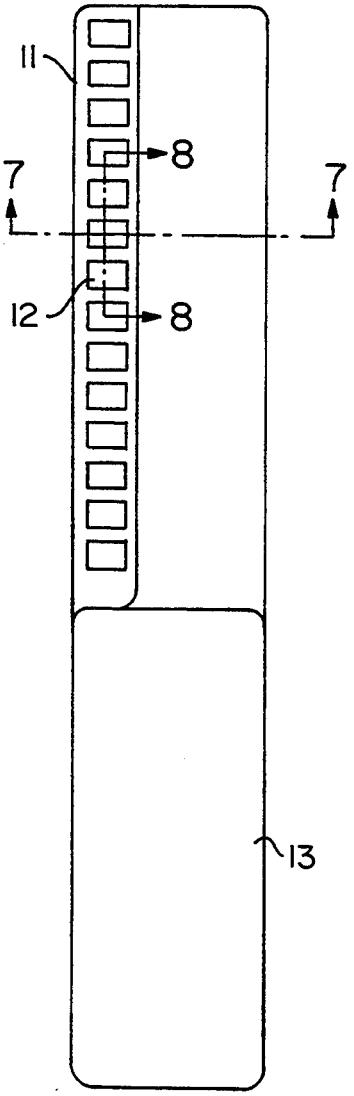
FIG. 6 is a front view of Example 2 of this invention for an LED display apparatus.

FIG. 6 shows an LED display apparatus of Example 2 of this invention. A protective case 11 is equipped with a protective rib, and composed of an LED array 12 and an apparatus body case 13. As in Example 1 of FIG. 1, batteries and switches are contained in the apparatus body case.

Figure 7:
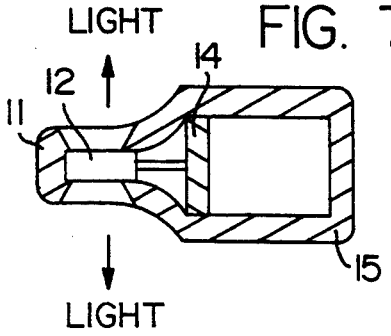
FIG. 7 is a cross-sectional view of an LED display apparatus of this invention with a protective case that is different from the one shown in FIG. 6. The view is taken along the line corresponding to the line 7—7 of FIG. 6.

FIG. 7 shows a cross-Sectional view taken along the line 7—7 of FIG. 6. The protective case 11 contains a base board 14 put together with the apparatus body case 13. An LED array 12 is mounted on the base board 14. The base board 14 and the protective case 11 are put together with a case 15.

Figure 8:
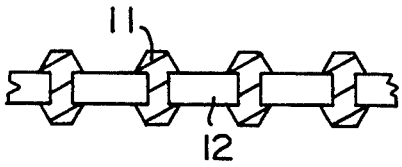
FIG. 8 is a cross-sectional view of an LED display apparatus of this invention with a protective case that is different from the one shown in FIG. 6. The view is taken along the line corresponding to the line 8—8 of FIG. 6.

FIG. 8 shows a cross-sectional view taken along the line 8—8 of FIG. 6. The protective case 11 has protective ribs, too, between LEDs of the LED array 12.

Figure 9:
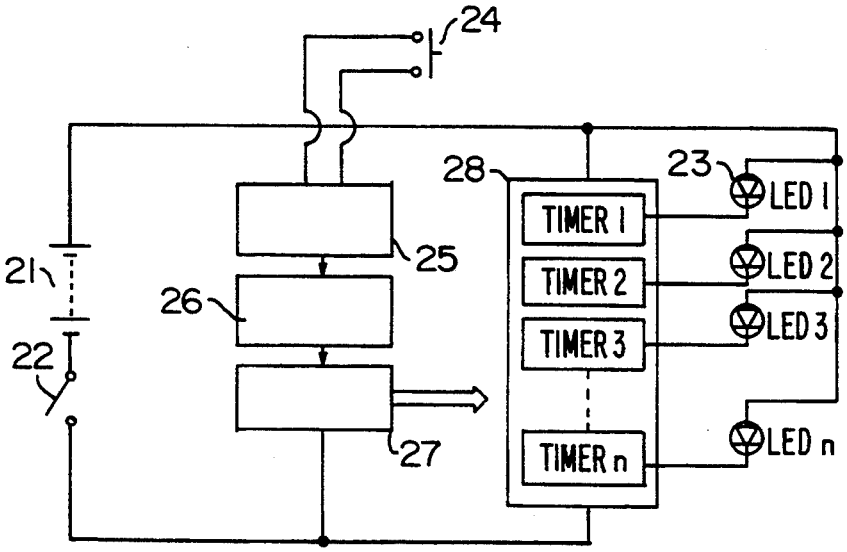
FIG. 9 is a circuit block diagram of an LED display apparatus of this invention.

FIG. 9 shows a circuit block diagram of an LED display apparatus of this invention. As shown in this diagram, power source batteries 21 supply electric currents to various units.

Item 22 is a power source switch and item 23 is an array of LEDs. Item 24 is a sensor switch that detects the cycle of the right and left reciprocating motion of the LED array 23. Item 25 is a measuring unit that receives a signal from the sensor switch 24, measures the cycle time of the right and left reciprocating motion and outputs an average value of the measured the cycle time. Item 26 is a computing unit that processes the cycle time information from the measuring unit 25 and outputs the results. Item 27 is a memory unit that stores as a memory the switching timing data outputted from the computing unit. Item 28 is a timer circuit unit that drives timers according to the turn on and off timing data stored at the memory unit and turns on and off the LEDs.

Figure 10:
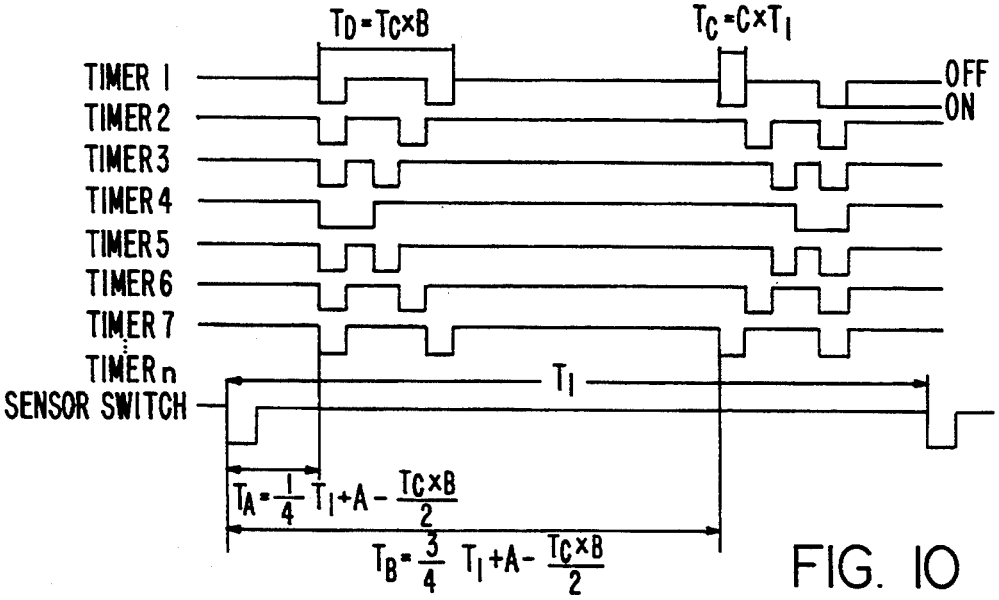
FIG. 10 is a timing diagram for LEDs of an LED display apparatus of this invention.
Figure 11A:
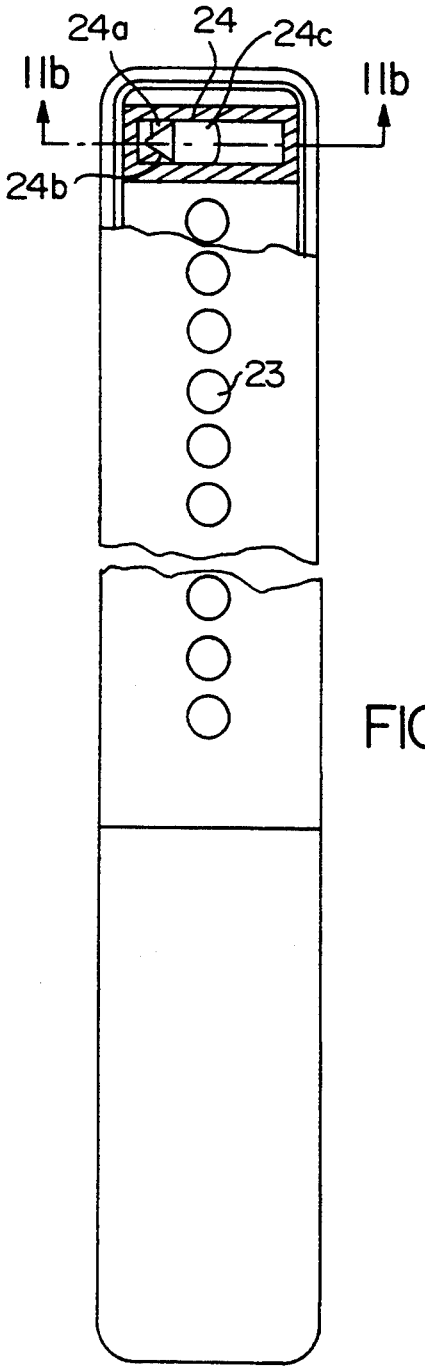
FIG. 11(*a*) is a partially cutaway view of a sensor switch of an LED display apparatus of this invention to show the structure of the switch.
Figure 11B:
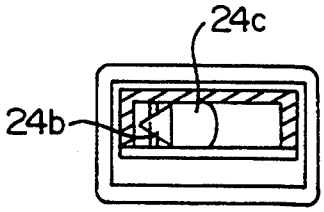

With regard to the LED display apparatuses constituted as above, how they operate is explained in the following: First, the power source switch 22 is turned on and the LED display apparatus is held by an operator and then the LED array 23 is moved right and left repeatedly. At this moment the sensor switch 24 generates a signal for each cycle of the reciprocating motion. As shown in FIG. 11, the sensor switch 24 is placed at the upper segment of the LED array and when the display apparatus reaches the extreme left of the reciprocating motion the movable contact 24*c* touches on the fixed contacts 24*a* and 24*b* turning on the sensor switch. The period between this ON signal outputted from the sensor switch and the next one is measured several times at the measuring unit 25 and the measured values are averaged out. As shown in FIG. 10, the computing unit 26 calculates a turn on time Tc for each timing from the foregoing average cycle time $T_1$ using the following equation 1:

$$Tc = C \times T_1, \text{ where } C \text{ is a constant.} \qquad \text{Equation 1}$$

When the display apparatus is swung by an operator for displaying images of pictures, letters, etc. the apparatus starts displaying at a turn on time $T_A$ during its reciprocating motion from left to right and starts displaying at $T_B$ during the motion from right to left. $T_A$ and $T_B$ are calculated from the equations 2 and 3 as follows:

$$T_A = \tfrac{1}{4}T_1 + A - T_C \times B/2 \qquad \text{Equation 2}$$

$$T_B = \tfrac{3}{4}T_1 + A - T_C \times B/2, \qquad \text{Equation 3}$$

where A is a compensated time of the center value and B is a turning on and off number-of LEDs counted along the time axis.

The calculated values of $T_A$, $T_B$ and $T_C$ are outputted to the memory unit 27 where a turning on and off pattern stored in memory in advance according to the pictures, letters, etc. to be displayed, and $T_A$, $T_B$ and $T_C$ are combined and memorized.

Figure 12:
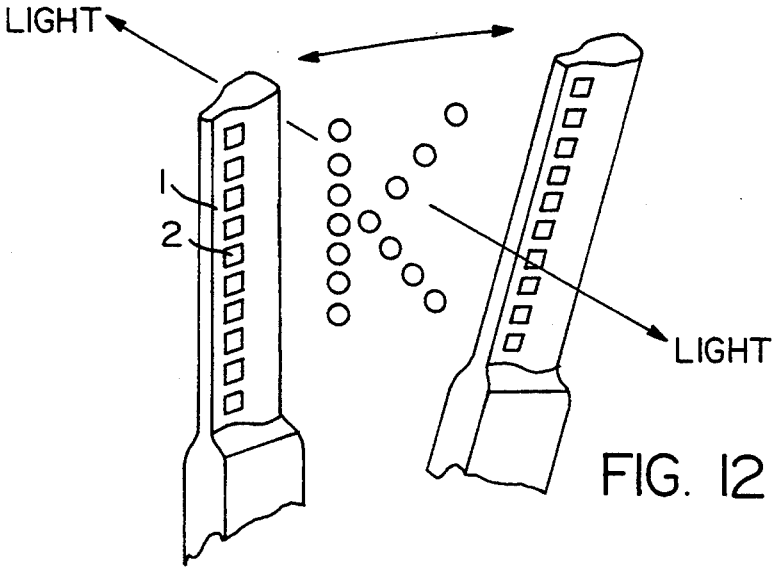
FIG. 12 is a perspective illustration to show how images of a letter are displayed by an LED display apparatus of this invention.
Figure 13:
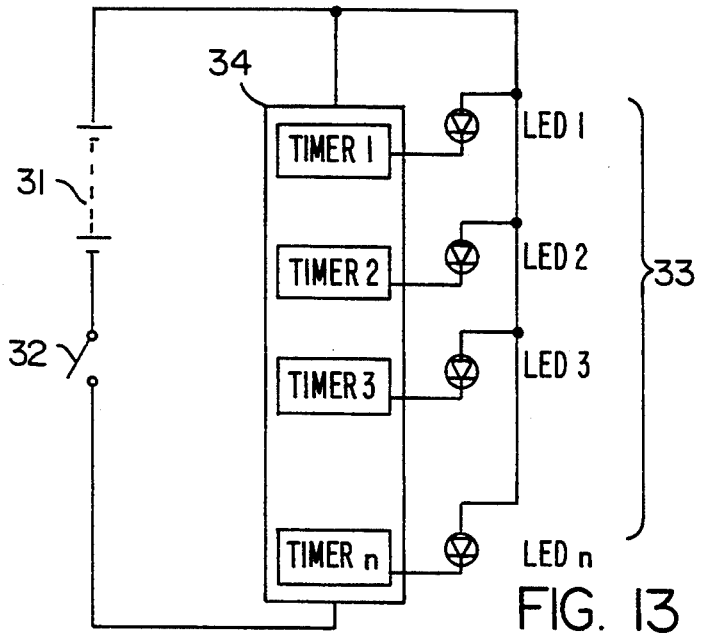
FIG. 13 PRIOR ART
FIG. 13 is a circuit block diagram of a conventional LED display apparatus.
Figure 14:
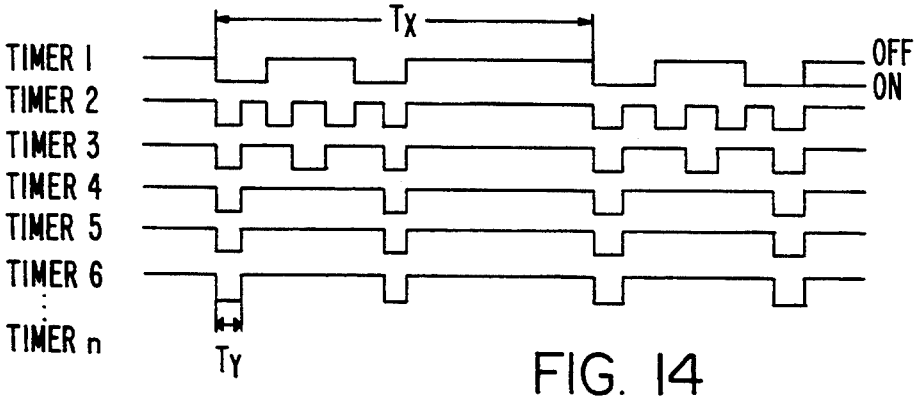
FIG. 14 PRIOR ART
FIG. 14 is a timing diagram of a conventional LED display apparatus.
Figure 15:
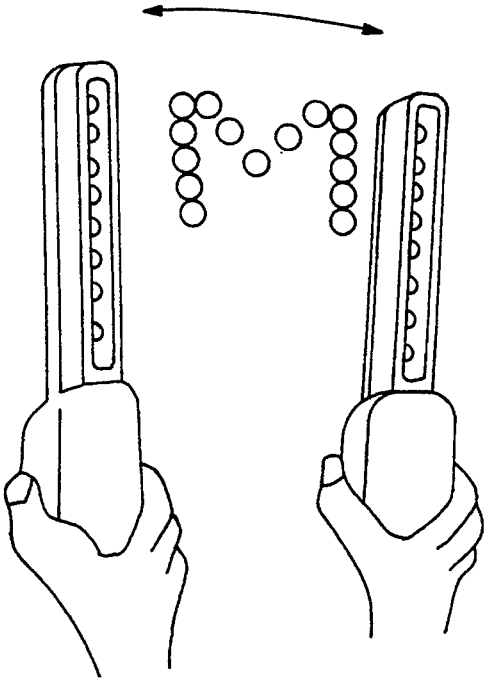
FIG. 15 is a perspective illustration to show how images of a letter are displayed by a conventional LED display apparatus.
Figure 16A:
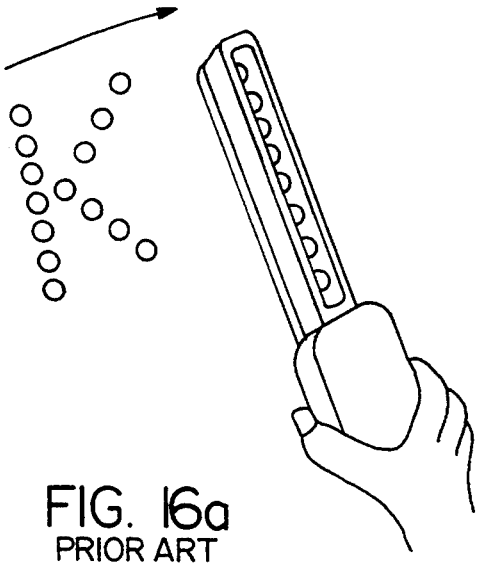
FIG. 16a PRIOR ART
FIG. 16(*a*) is a perspective illustration to show how images of a letter are displayed by a conventional LED display apparatus when it is moved from left to right.
Figure 16B:
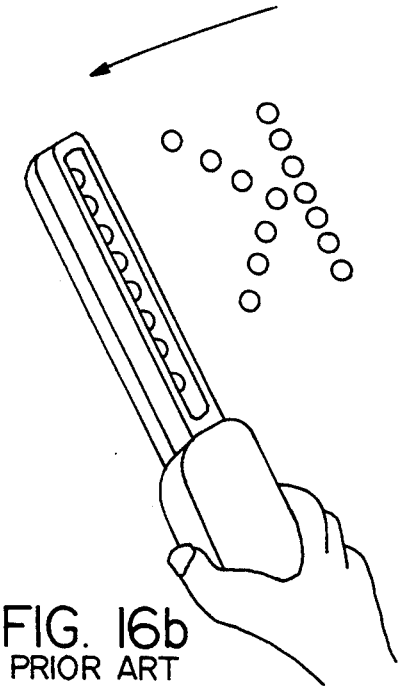
FIG. 16b PRIOR ART

The timer unit 28 activates each timer in coordination with the turning on and off data as stored in the memory unit 27 and also in synchronization with the signals generated at the sensor switch 24, consequently turning on and off LEDs in sequence. These going on and off LEDs are, as explained in the examples of FIG. 2, FIG. 3, FIG. 6 and FIG. 7, emitting light in two directions, front and back, through the protective cases. (See FIG. 12.)

This whole set-up enables an operator of the LED display apparatus to transmit such information as pictures, letters, etc., primarily at night, securely to the opposite party as the apparatus is held and moved to the right and left by the operator.

In addition, irrespective of the speed of the operator's waving action, images are always displayed in the central area of space and the dimensions of the images are always adjusted to the optimal ones. Even asymmetrical pictures, letters, etc. are made to display by the reciprocating motion from both left and right.

According to the foregoing examples of this invention, the going on and off LEDs are protected from external impact by a transparent protective case, a protective case with an edge light effect or an apparatus body case that is integrated with prisms and protective ribs as a single body. Further, the light from the LED array is made to emit from both sides, front and back, of the apparatus. Moreover, the cycle period of the right and left reciprocating motion of an LED display apparatus moved by an operator is measured and the measured values are computer processed to obtain the center value of the range of the reciprocating motion for displaying images of pictures, letters, etc. and also to obtain the optimal turn on and off timing for keeping the image dimensions constant and finally to fix the turn on and off timing for the LEDs.

Furthermore, the turn on and off timing is reversed depending on the direction of the reciprocating motion of the apparatus, to display images correctly.

Effectiveness of the Invention

As the foregoing examples of this invention clarify, an LED display apparatus held by an operator's hand and applied with a right and left reciprocating motion displays images of pictures, letters, etc. in space by the help of a human eye's afterimage effect. The LED display apparatus is constructed so as to have an LED array protected from external impact as caused by smashing and the like, and light of LEDs emitted in two directions, front and back, from the apparatus. Consequently, the operator is able to recognize and transmit securely what he intends to send as information to the opposite party.

In addition, images of pictures, letters, etc. are displayed always in the central position of the range of the reciprocating motion, irrespective of the speed of the operator's right and left waving action and image sizes are kept stable and constant at the optimal dimensions.

Even images of asymmetrical pictures, letters, etc. are made to display without reversal and with a more distinct afterimage effect since images are displayed during both right and left directions of the reciprocating motion.

What is claimed:

1. A hand held LED display apparatus comprising:

a body including a front and a back;

an array of LEDs arranged in line and coupled to the body;

inertial sensor means, situated in said body at one end of the LED array, consisting of a pair of fixed contacts and a moveable contact for generating at least one signal indicating a change in inertia of said apparatus responsive to an inertial force produced when said apparatus is reciprocated from a first direction to a second direction;

memory means for receiving and storing data representing timing for turning on and off each individual LED; and control means coupled to said memory means, said inertial sensor means and said LEDs for receiving said timing data from said memory means, for receiving said at least one signal from said inertial sensor means and for providing signals to turn on and turn off the LEDs according to the timing data and said at least one signal so that light is displayed and afterimages are caused which are perceived to form an image when said apparatus is moved within a range with reciprocating motion.

2. An LED display apparatus according to claim 1, wherein said protective case includes a plurality of portions forming protective ribs, said protective ribs being situated between respective pairs of LEDs in said LED array.

3. An LED apparatus according to claim 1, wherein:

said range has a right side and a left side, the apparatus is movable between said right side and said left side, said inertial sensor means including means for producing a first signal indicating when said apparatus is moved from the extreme right side to said left side and producing a second signal when the apparatus is moved from the extreme left side to said right side, and said control means a) for receiving said first and second signals, and b) for controlling said turn on and turn off signals to turn on and off said LEDs in response to said first signal and said second signal so that said image perceived from said afterimages is in the correct direction.

4. An LED apparatus according to claim 1, further comprising a transparent protective case that covers the LED array, and through which the LEDS emit light in at least two directions including towards the front of said body and toward the back of said body.

5. An LED display apparatus comprising:

a body including a front and a back;

an array of LEDs arranged in line and coupled to the body;

inertial sensor means, situated in said body at one end of the LED array, consisting of a pair of fixed contacts and a moveable contact for generating at least one signal indicating a change in inertia of said apparatus responsive to an inertial force produced when said apparatus is reciprocated from a first direction to a second direction, said sensor having means for measuring a cycle of reciprocating motion of said apparatus;

memory means for receiving and storing a plurality of signals representing timing data corresponding to the turning on and off of individual LEDs;

computing means for computing timing data for turning on and turning off the LEDs and providing said plurality of signals representing said timing data to said memory means; and a timer circuit having driving on-off timers that turns on and turns off the LEDs according to the plurality of signals corresponding to the timing data in the memory means so that light is displayed and afterimages are caused which are perceived to form an image when said apparatus is moved within a range with reciprocating motion;

wherein said computing means responsive to said at least one signal adjusts said timing data so that the image is displayed at the center of the range reciprocating motion.

6. An LED display apparatus according to claim 5, wherein the computing means computes the timing data for turning on and turning off from the cycle of the reciprocating motion.

7. An LED display apparatus according to claim 5, wherein:

said range has a right side and a left side, the apparatus is movable between said right side and said left side, the computing means computes timing for data to display the images starting from said left side when the apparatus is moved from said left side to said right side, and the computing means computes the timing data to display said image starting from said right side when the apparatus is moved from said right side to said left side.

8. An LED apparatus according to claim 5, further comprising a transparent case that protects the LED array, and through which light is emitted in at least two directions including towards the front of said body and towards the back of said body.

9. An LED apparatus, comprising:

a body;

an array of LEDs coupled to the body and emitting light in at least two directions;

inertial sensor means, situated in said body at one end of the LED array, consisting of a pair of fixed contacts and a moveable contact for generating at least one signal indicating a change in inertia of said apparatus responsive to an inertial force produced when said apparatus is reciprocated from a first direction to a second direction, said sensor having means for measuring a direction of motion of said body;

computing means a) for receiving said at least one signal from said sensor, and b) for computing timing data based on said at least one signal for turning on and turning off each LED of said array as a function of frequency of said body movement based upon said at least one signal, memory means for receiving and storing said timing data corresponding to the turning on and off of each LED of said array; and timing means, for turning on and turning off each LED of said array according to the timing data in the memory means.

10. An LED apparatus according to claim 9, wherein said LEDs are arranged in line.

11. An LED apparatus according to claim 9, wherein said array of LEDs emit light in at least two directions.

* * * * *